United States Patent [19]

Mühlhausen et al.

[11] Patent Number: 5,014,594

[45] Date of Patent: May 14, 1991

[54] UNBALANCE-COMPENSATING DEVICE FOR A WEAPONS SYSTEM ESPECIALLY A HEAVY WEAPON

[75] Inventors: Peter Mühlhausen, Ahnatal; Adolf Nausester, Habichtswald, both of Fed. Rep. of Germany

[73] Assignee: Wegman & Co. GmbH, Kassel, Fed. Rep. of Germany

[21] Appl. No.: 402,275

[22] Filed: Sep. 1, 1989

[30] Foreign Application Priority Data

Sep. 2, 1988 [DE] Fed. Rep. of Germany ..... 3829860

[51] Int. Cl.[5] ..... F41A 27/06

[52] U.S. Cl. ..... 89/37.08

[58] Field of Search ..... 89/37.08

[56] References Cited

U.S. PATENT DOCUMENTS 1,722,397 7/1929 Schuler et al. ..... 89/37.08

FOREIGN PATENT DOCUMENTS 714635 12/1941 Fed. Rep. of Germany .
3642628 6/1988 Fed. Rep. of Germany .
204683 2/1924 United Kingdom .

*Primary Examiner*—Stephen C. Bentley
*Attorney, Agent, or Firm*—Sprung Horn Kramer & Woods

[57] ABSTRACT

An unbalance-compensating device for a weapons system, especially a heavy weapon, with an assembly that has the tube mounted on it, that pivots in the direction of elevation, and that is mounted on a trunnion in a stationary base, whereby the center of gravity of the pivoting assembly is outside the axis of rotation of the trunnion and wherein a torque that opposes the moment of unbalance is generated by at least one suspension mechanism. The suspension system consists of at least one torsion-bar suspension mechanism, one end of which is non-rotationally secured to the base and the other end of which is secured to the weapon's pivoting assembly by way of a transmission mechanism.

9 Claims, 3 Drawing Sheets

UNBALANCE-COMPENSATING DEVICE FOR A WEAPONS SYSTEM ESPECIALLY A HEAVY WEAPON

BACKGROUND OF THE INVENTION

The invention concerns an unbalance-compensating device for a weapons system, especially a heavy weapon, with an assembly that has the tube mounted on it, that pivots in the direction of elevation, and that is mounted on a trunnion in a stationary base, whereby the center of gravity of the pivoting assembly is outside the axis of rotation of the trunnion and wherein a torque that opposes the moment of unbalance is generated by at least one suspension mechanism.

Aiming a large-caliber weapons system takes a lot of force, meaning that high output is necessary to achieve rapid aiming. This expenditure of force derives from the weight of the weapon's pivoting assembly and increases with the distance of their center of gravity from their axis of rotation. When the weapon is aimed, accordingly, the gravity-dictated moment of weight, called the unbalance moment hereinafter and deriving from the weight of the pivoting assembly and the center-of-gravity distance, must be overcome.

Keeping the aiming mechanism and the requisite aiming output small by providing the weapons system with an unbalance-compensating device is known. This is in particular necessary when the output available to the aiming mechanism, the power on board a military tank for example, is limited or when the weapon must be aimed manually, in an emergency situation for example.

Unbalance-compensating devices that compensate the unbalance moment with suspension systems, mechanical suspension cylinders for example, are known. A severe drawback of such suspension systems is that, since their stroke is very long, especially at a wide aiming angle, they occupy a lot of space.

Also known from German OS 3 642 628 is an unbalance-compensating device that converts the unbalance moment into a pressure that acts in a hydropneumatic-reservoir system. The mechanism that converts the unbalance moment is a hydraulic rotating cylinder. Its drive shaft is rotationally coupled to the weapon's pivoting assembly. At least one of the compression-liquid connections communicates by way of a hydraulic system with a hydraulic reservoir.

This system as well occupies a comparatively large volume of space and is fairly expensive in that it involves a hydraulic system that comprises a series of controls, valves, and similar components.

SUMMARY OF THE INVENTION

The object of the invention is to improve an unbalance-compensating device with the aforesaid characteristics to the extent that it is very simple, weighs little, occupies very little space, and provides satisfactory compensation of the unbalance moment even at wide aiming angles.

This object is attained in accordance with the invention by the improvement wherein the suspension system consists of at least one torsion-bar suspension mechanism, one end of which is non-rotationally secured to the base and the other end of which is secured to the weapon's pivoting assembly by way of a transmission mechanism.

The transmission mechanism can be a cogwheel transmission positioned between a cogwheel that is non-rotationally secured to the second end of the torsion-bar suspension mechanism and a toothed segment positioned on the weapon's pivoting assembly.

The transmission mechanism can have a lever that is non-rotationally secured to the second end if the torsion-bar suspension mechanism and articulated to a thrust rod that is in turn articulated to the weapon's pivoting assembly.

At least one torsion-bar suspension mechanism can be positioned parallel to the axis of rotation of the weapon's trunnion.

The torsion-bar suspension mechanism can be position upstream of the trunnion along the direction of fire and below the weapon's pivoting assembly.

The torsion-bar suspension mechanism can be concentrically positioned at least along part of its length in a protective cylinder that rotates in the base with one end non-rotationally secured to the second end of the torsion-bar suspension mechanism and the mechanism that transmits the rotation can be secured to the protective cylinder.

The protective cylinder can be a torsion-bar suspension mechanism.

The unbalance-compensating device can have several mutually aligned or parallel torsion-bar suspension mechanisms trained in parallel and/or in series.

The basic principle of the invention is to use a torsion-bar suspension mechanism of the type employed for example for the wheels in a vehicle instead of a suspension mechanism with a linear range, a helical compression spring or a package of cup springs with a relatively long stroke for example, for the suspension in an unbalance-compensating device wherein a torque that opposes the moment of unbalance is generated by at least one suspension mechanism. Torsion-bar suspension mechanisms of these dimensions attain high torques and wide angles of torsion. They have a linear characteristic. The characteristic of the system consisting of the torsion-bar suspension mechanism and of the mechanism that transmits the torque can be very closely approximated to the unbalance curve of the weapon's elevation by employing a torsion-bar suspension mechanism with an appropriate diameter and length and by appropriately designing the transmission mechanism as will be described in greater detail hereinafter.

Any differential moments between the weapon's unbalance and the unbalance-compensating device are compensated by the existing aiming mechanism.

The torque that counteracts the unbalance moment is transmitted from the torsion-bar suspension mechanism to the weapon's pivoting assembly by a mechanism that can basically be a cogwheel transmission. One particularly advantageous and simple embodiment uses a lever-based transmission that varies the moment to be transmitted in accordance with the position of the point of rotation and the length of the lever secured to the torsion-bar suspension mechanism and adjusts it as already mentioned herein to the unbalance curve of the weapons' elevation.

The torsion-bar suspension mechanism in the unbalance-compensating device in accordance with the invention can be positioned in front of the weapon's cockpit, saving space, protecting the crew from injury if the suspension system bursts, and ensuring satisfactory access and rapid replacement of the torsion-bar suspension mechanism.

Another advantage is that, when the unbalance-compensating device is employed in an armored vehicle for example, the same type of suspension can be used in the unbalance-compensating device and in the vehicle.

The characteristic of the unbalance-compensating device can in particular be adjusted to the unbalance curve even more effectively when the differential moment exerted by the aiming mechanism is to be kept particularly small by using several torsion-bar suspension mechanisms, at least some of which have different spring characteristics, trained in parallel or in series.

BRIEF DESCRIPTION OF THE DRAWINGS

One embodiment of an unbalance-compensating device in accordance with the invention will now be described in greater detail with reference to the drawings, wherein.

DETAILED DESCRIPTION OF THE INVENTION

Figure 1:
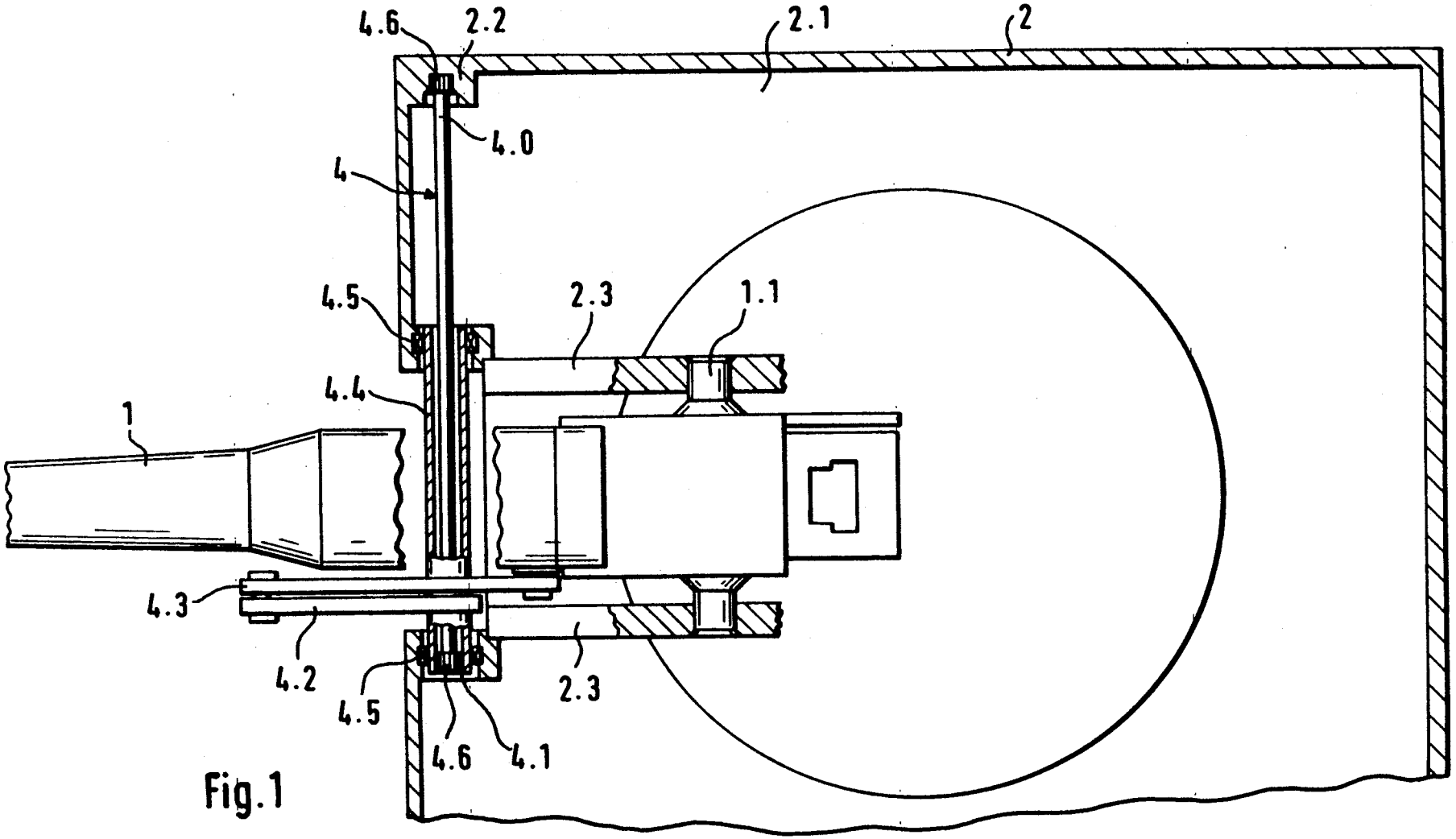
FIG. 1 is a schematic and partly sectional top view of part of a weapons system with an unbalance-compensating device at the turret of a military tank.
Figure 2:
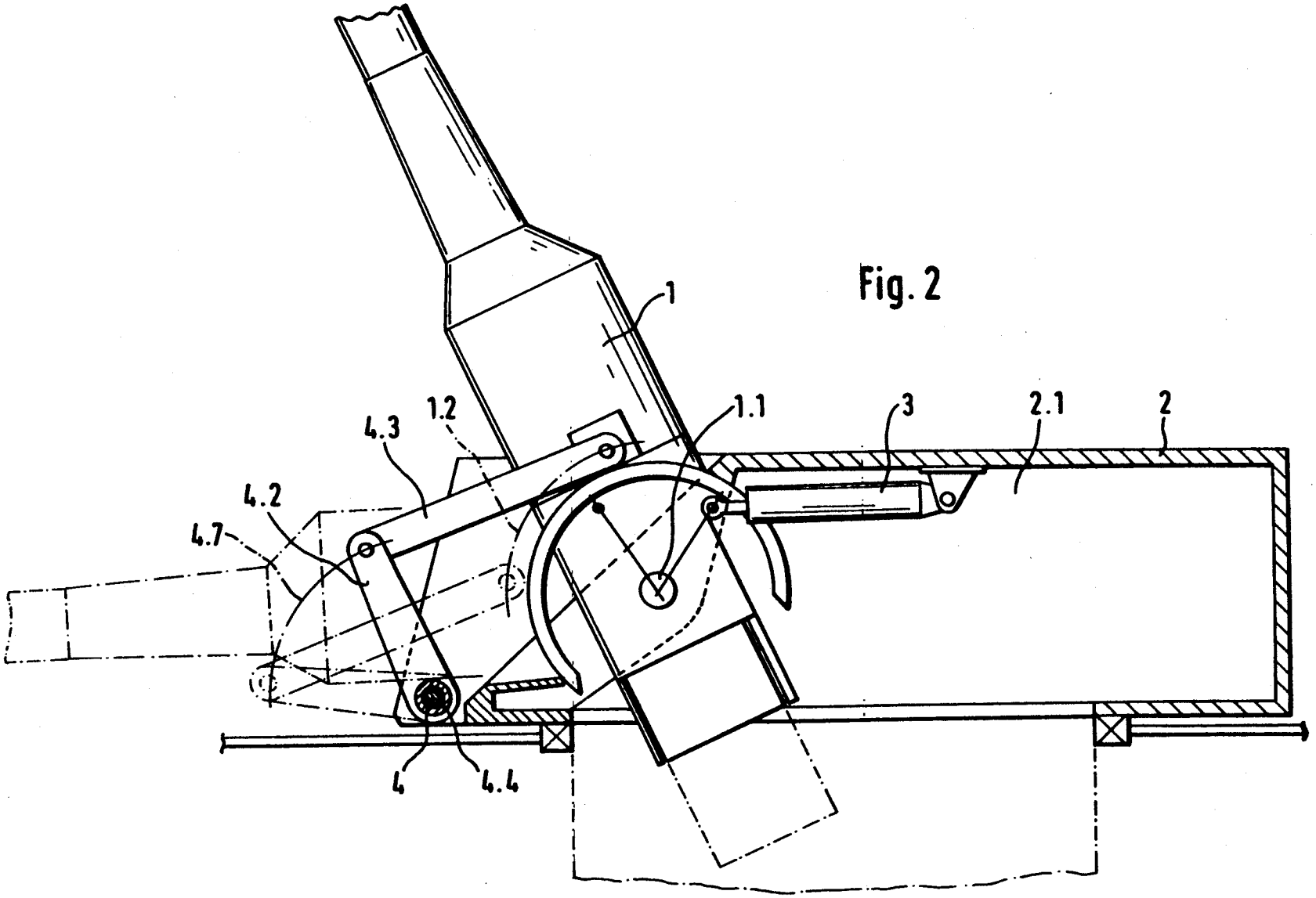
FIG. 2 is a partly sectional side view of the weapons system and unbalance-compensating device illustrated in FIG. 1.

FIGS. 1 and 2 are highly schematic representations of a weapons system in the turret of a military tank with a stationary base or gun carriage in the form of a stationary base and a pivoting assembly 1 in the form of a tube and cradle. Assembly 1 can be pivoted in the elevation direction on a trunnion 1.1 in a turret 2 by an aiming mechanism 3.

Accommodated in the interior 2.1 of turret 2, parallel to the axis of rotation of trunnion 1.1 and accordingly upstream of the trunnion in the direction of fire, and below pivoting assembly 1 is a torsion-bar suspension mechanism 4, one end 4.0 of which is secured by way of a series of notches 4.6 in a pillow block 2.2 that is secured to turret 2. The other and free end of 4.1 of torsion-bar suspension mechanism 4 is non-rotationally secured by another series of notches 4.6 to a protective cylinder 4.4. The cylinder concentrically surrounds torsion-bar suspension mechanism 4 to about half its length and rotates on ball or roller bearings 4.5 in the walls 2.3 of the weapon well. Secured to the outside circumference of protective cylinder 4.4 is a lever 4.2 that is articulated to one end of a thrust rod 4.3. The other end of the thrust rod is articulated to the other end of pivoting assembly 1. The torque of torsion-bar suspension mechanism 4 is initially transmitted to protective cylinder 4.4, which also, due to its resiliency, acts as a torsion-bar suspension mechanism, and hence by way of lever 4.2 and thrust rod 4.3 to pivoting assembly 1. A crank throw 1.2 is dictated by the point of articulation to pivoting assembly 1, and lever 4.2 has a crank throw 4.7. The particular crank throws 1.2 and 4.7 employed dictate the tension, the torsion angle, and the moment of torsion-bar suspension mechanism 4 that is to be transmitted.

Pivoting assembly 1 and lever transmission mechanism are illustrated in two different positions in FIG. 2, one with continuous lines and the other with dot-and-dash lines.

The characteristic of the unbalance-compensating device can be very satisfactorily adjusted to the weapon's unbalance curve even when only one torsion-bar suspension mechanism is employed.

Figure 3:
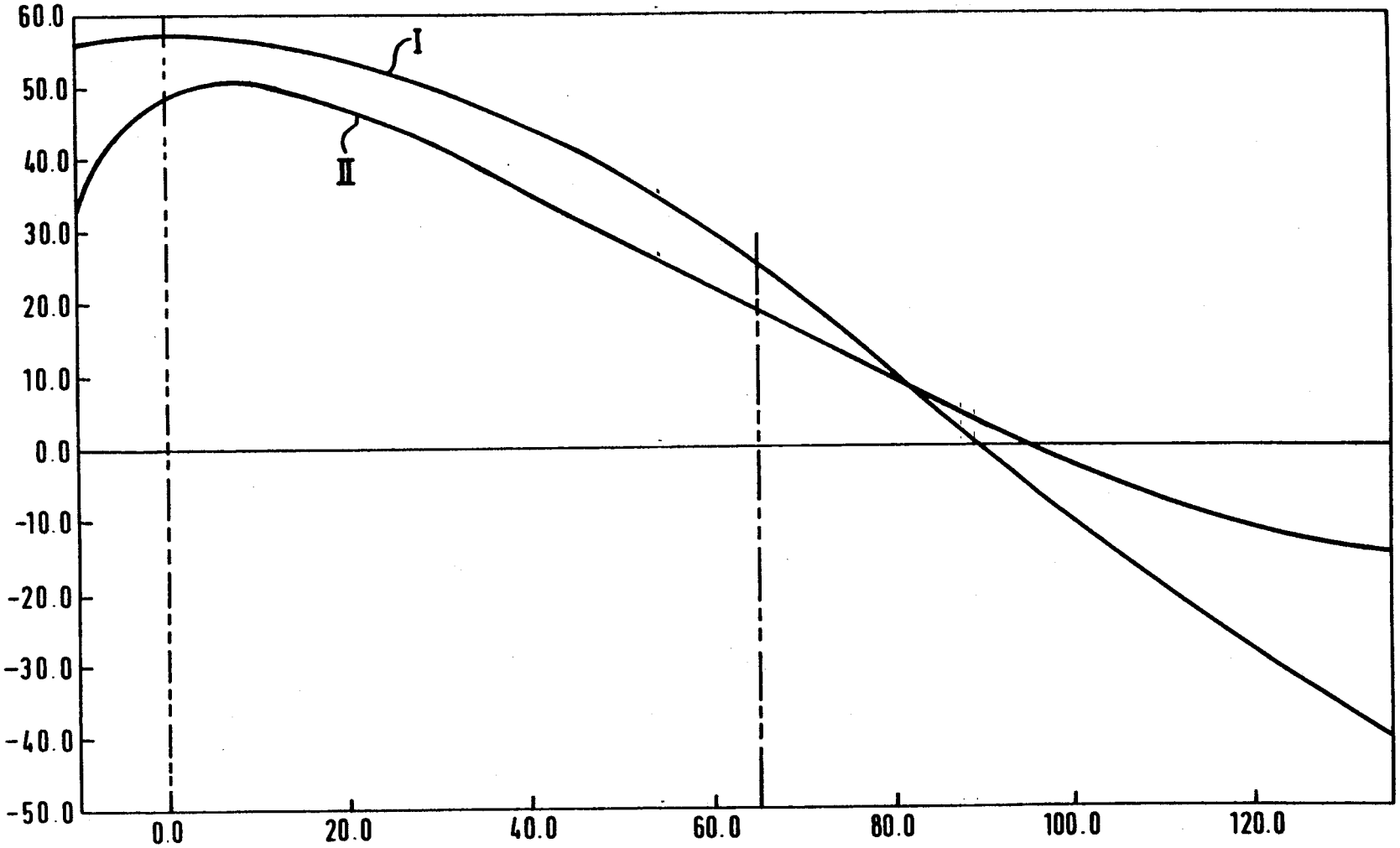
FIG. 3 is a graph of the weapon's system's unbalance curve and of the unbalance-compensating device's characteristic.

FIG. 3 illustrates one example of such compensation.

FIG. 3 illustrates the various moments as a function of weapon elevation. Curve I represents the weapon's unbalance curve and curve II the contrary torque exerted by the unbalance-compensating device. The unbalance moment plots, as is known, a cosine, and FIG. 3 clearly illustrates that the contrary torque can be very closely approximated to the unbalance moment over a wide range of elevations, with only minor differential moments, which have to be compensated by aiming mechanism 3, left over.

It will be appreciated that the instant specifications and claims are set forth by way of illustration and not limitation, and that various modifications and changes may be made without departing from the spirit and scope of the present invention.

What is claimed is:

1. In a weapons system having a stationary base and an assembly with a tube and means mounting the tube for pivotal movement in a direction of elevation including a trunnion having an axis of rotation and wherein the center of gravity of the assembly is outside the axis of rotation of the trunnion to effect a moment of unbalance and an imbalance-compensating device for generating a torque that opposes the movement of unbalance, the improvement wherein the device comprises at least one torsion-bar suspension mechanism positioned upstream of the trunnion along a direction of fire and below the assembly and positioned parallel to the axis of rotation of the trunnion and having a first end which is non-rotationally secured to the base and a transmission mechanism securing a second end of the torsion-bar suspension mechanism to the assembly, wherein the transmission mechanism has a lever that is non-rotationally secured to the second end of the torsion-bar suspension mechanism and articulated to a thrust rod that is in turn articulated to the assembly.

2. The unbalance-compensating device as in claim 1, wherein the transmission mechanism comprises a cogwheel transmission positioned between a cogwheel that is non-rotationally secured to the second end of the at least one torsion-bar suspension mechanism and a toothed segment positioned on the assembly.

3. The unbalance-compensating device as in claim 1, wherein the at least one torsion-bar suspension mechanism is concentrically positioned at least along part of its length in a protective cylinder that rotates in the base with one end non-rotationally secured to the second end of the at least one torsion-bar suspension mechanism and wherein the transmission mechanism is secured to the protective cylinder.

4. The unbalance-compensating device as in claim 3, wherein the protective cylinder is a torsion-bar suspension mechanism.

5. In a weapons system having a stationary base and an assembly with a tube and means mounting the tube for pivotal movement in a direction elevation including a trunnion having an axis of rotation and wherein the center of gravity of the assembly is outside the axis of rotation of the trunnion to effect a moment of unbalance and an unbalance-compensating device for generating a torque that opposes the movement of unbalance, the improvement wherein the device comprises at least one torsion-bar suspension mechanism having a first end which is non-rotationally secured to the base and a transmission mechanism securing a second end of the torsion-bar suspension mechanism to the assembly, wherein the at least one torsion-bar suspension mechanism is concentrically positioned at least along part of its length in a protective cylinder that rotates in the base with one end non-rotationally secured to the second end of the at least one torsion-bar suspension mechanism and wherein the transmission mechanism is secured to the protective cylinder and wherein the protective cylinder is a torsion-bar suspension mechanism.

6. The unbalance-compensating device as in claim 5, wherein the transmission mechanism comprises a cogwheel transmission positioned between a cogwheel that is non-rotationally secured to the second end of the at least one torsion-bar suspension mechanism and a toothed segment positioned on the assembly.

7. The unbalance-compensating device as in claim 5, wherein the transmission mechanism has a lever that is non-rotationally secured to the second end of the torsion-bar suspension mechanism and articulated to a thrust rod that is in turn articulated to the assembly.

8. The unbalance-compensating device as in claim 5, wherein at least one torsion-bar suspension mechanism is positioned parallel to the axis of rotation of the trunnion.

9. The unbalance-compensating device as in claim 8, wherein the torsion-bar suspension mechanism is positioned upstream of the trunnion along a direction of fire and below the assembly.

* * * * *